US007133035B2

(12) United States Patent
Kim et al.

(10) Patent No.: US 7,133,035 B2
(45) Date of Patent: Nov. 7, 2006

(54) METHOD AND APPARATUS FOR DRIVING LIQUID CRYSTAL DISPLAY DEVICE

(75) Inventors: Jong Dae Kim, Kyoungsangbuk-do (KR); Sun Young Kwon, Kyoungsangbuk-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 405 days.

(21) Appl. No.: 10/602,765

(22) Filed: Jun. 25, 2003

(65) Prior Publication Data

US 2004/0239602 A1 Dec. 2, 2004

(30) Foreign Application Priority Data

Jul. 22, 2002 (KR) ..... 10-2002-0042973

(51) Int. Cl.
*G09G 3/36* (2006.01)

(52) U.S. Cl. ..... 345/204; 345/87; 345/96; 345/98; 345/214

(58) Field of Classification Search ..... 345/55, 345/87, 96, 98, 204, 209, 210, 214
See application file for complete search history.

(56) References Cited

U.S. PATENT DOCUMENTS 4,484,192 A * 11/1984 Seitz et al. ..... 340/995.18
5,270,697 A * 12/1993 Takeda ..... 345/96
5,592,187 A * 1/1997 Zenda ..... 345/3.2
5,796,379 A * 8/1998 Enomoto et al. ..... 345/89
5,801,767 A * 9/1998 Wu ..... 348/190
5,805,149 A * 9/1998 Yuki et al. ..... 345/555
6,366,271 B1 * 4/2002 Kohno et al. ..... 345/103
2001/0046002 A1 * 11/2001 Lin et al. ..... 349/43

* cited by examiner

*Primary Examiner*—Bipin Shalwala
*Assistant Examiner*—Vincent E. Kovalick
(74) *Attorney, Agent, or Firm*—Morgan, Lewis & Bockius, LLP

(57) ABSTRACT

A driving apparatus for a liquid crystal display device includes a liquid crystal display panel having a plurality of data lines and gate lines arranged in a matrix configuration, a data driver for supplying video data to the data lines, a gate driver for supplying gate pulses to the gate lines, and a timing controller for controlling polarity of the video data by supplying a polarity inversion signal to the data driver and controlling a timing of the data driver and the gate driver according to a number of horizontal synchronization signals supplied during a data blanking period, wherein a plurality of the polarity inversion signals are different from each other.

20 Claims, 14 Drawing Sheets

FIG.2A
RELATED ART

| R | G | B | R | G | B |
|---|---|---|---|---|---|
| + | − | + | − | + | − |
| + | − | + | − | + | − |
| − | + | − | + | − | + |
| − | + | − | + | − | + |
| + | − | + | − | + | − |
| + | − | + | − | + | − |
| − | + | − | + | − | + |
| − | + | − | + | − | + |

FIG.2B
RELATED ART

| R | G | B | R | G | B |
|---|---|---|---|---|---|
| − | + | − | + | − | + |
| − | + | − | + | − | + |
| + | − | + | − | + | − |
| + | − | + | − | + | − |
| − | + | − | + | − | + |
| − | + | − | + | − | + |
| + | − | + | − | + | − |
| + | − | + | − | + | − |

FIG.3A
RELATED ART

| R | G | B | R | G | B |
|---|---|---|---|---|---|
| + | − | + | − | + | − |
| − | + | − | + | − | + |
| − | + | − | + | − | + |
| + | − | + | − | + | − |
| + | − | + | − | + | − |
| − | + | − | + | − | + |
| − | + | − | + | − | + |
| + | − | + | − | + | − |

FIG.3B
RELATED ART

| R | G | B | R | G | B |
|---|---|---|---|---|---|
| − | + | − | + | − | + |
| + | − | + | − | + | − |
| + | − | + | − | + | − |
| − | + | − | + | − | + |
| − | + | − | + | − | + |
| + | − | + | − | + | − |
| + | − | + | − | + | − |
| − | + | − | + | − | + |

| R | G | B | R | G | B | R | G | B |
|---|---|---|---|---|---|---|---|---|
| + | ▨ | + | − | + | − | + | ▨ | + |
| + | ▨ | + | − | + | − | + | ▨ | + |
| − | + | − | + | ▨ | + | − | + | − |
| − | + | − | + | ▨ | + | − | + | − |

▨ Half Gray

□ Black

| R | G | B | R | G | B | R | G | B |
|---|---|---|---|---|---|---|---|---|
| + | ▨ | + | − | + | − | + | ▨ | + |
| − | + | − | + | ▨ | + | − | + | − |
| − | + | − | + | ▨ | + | − | + | − |
| + | ▨ | + | − | + | − | + | ▨ | + |

▨ Half Gray

□ Black

FIG.9A
RELATED ART

FLICKER INSPECTION PATTERN

| R | G | B | R | G | B |
|---|---|---|---|---|---|
| + | − | + | − | + | − |
| + | − | + | − | + | − |
| − | + | − | + | − | + |
| − | + | − | + | − | + |

a

| R | G | B | R | G | B |
|---|---|---|---|---|---|
| + | − | + | − | + | − |
| − | + | − | + | − | + |
| − | + | − | + | − | + |
| + | − | + | − | + | − |

b

⇓

| R | G | B | R | G | B |
|---|---|---|---|---|---|
| + | − | + | − | + | − |
| + | − | + | − | + | − |
| − | + | − | + | − | + |
| − | + | − | + | − | + |

c

FIG.9B
RELATED ART

FLICKER INSPECTION PATTERN

| R | G | B | R | G | B |
|---|---|---|---|---|---|
| + | − | + | − | + | − |
| − | + | − | + | − | + |
| − | + | − | + | − | + |
| + | − | + | − | + | − |

a

| R | G | B | R | G | B |
|---|---|---|---|---|---|
| + | − | + | − | + | − |
| + | − | + | − | + | − |
| − | + | − | + | − | + |
| − | + | − | + | − | + |

b

⇓

| R | G | B | R | G | B |
|---|---|---|---|---|---|
| + | − | + | − | + | − |
| − | + | − | + | − | + |
| − | + | − | + | − | + |
| + | − | + | − | + | − |

c 100a
102a
104
106
108
110
112
114
116
118
134
136
138
140
142
300M
200M
POL
POL1
POL2
POLS
VSRB
Hsync
Vsync
Reset
CLK
VCC
DE
IVT
D Q1
BQ1
D Q2
BQ2
D Q3
BQ3
D Q4
D Q5
D Q6
D Q7
D Q8
DF4
DF5
DF6
DF7
DF8
LD
A
B
C
D
ED
ET
RC
CK
CL
QA
QB
QC
QD

FIG.16A

| R | G | B | R | G | B |
|---|---|---|---|---|---|
| + | − | + | − | + | − |
| + | − | + | − | + | − |
| − | + | − | + | − | + |
| − | + | − | + | − | + |
| + | − | + | − | + | − |
| + | − | + | − | + | − |
| − | + | − | + | − | + |
| − | + | − | + | − | + |

FIG.16B

| R | G | B | R | G | B |
|---|---|---|---|---|---|
| − | + | − | + | − | + |
| − | + | − | + | − | + |
| + | − | + | − | + | − |
| + | − | + | − | + | − |
| − | + | − | + | − | + |
| − | + | − | + | − | + |
| + | − | + | − | + | − |
| + | − | + | − | + | − |

FIG.17A

| R | G | B | R | G | B |
|---|---|---|---|---|---|
| + | − | + | − | + | − |
| − | + | − | + | − | + |
| − | + | − | + | − | + |
| + | − | + | − | + | − |
| + | − | + | − | + | − |
| − | + | − | + | − | + |
| − | + | − | + | − | + |
| + | − | + | − | + | − |

FIG.17B

| R | G | B | R | G | B |
|---|---|---|---|---|---|
| − | + | − | + | − | + |
| + | − | + | − | + | − |
| + | − | + | − | + | − |
| − | + | − | + | − | + |
| − | + | − | + | − | + |
| + | − | + | − | + | − |
| + | − | + | − | + | − |
| − | + | − | + | − | + |

FIG.18

| R | G | B | R | G | B | R | G | B |
|---|---|---|---|---|---|---|---|---|
| + | − | + | − | + | − | + | − | + |
| + | − | + | − | + | − | + | − | + |
| − | + | − | + | − | + | − | + | − |
| − | + | − | + | − | + | − | + | − |

Half Gray

Black

FIG.19

| R | G | B | R | G | B | R | G | B |
|---|---|---|---|---|---|---|---|---|
| + | − | + | − | + | − | + | − | + |
| − | + | − | + | − | + | − | + | − |
| − | + | − | + | − | + | − | + | − |
| + | − | + | − | + | − | + | − | + |

Half Gray

Black

METHOD AND APPARATUS FOR DRIVING LIQUID CRYSTAL DISPLAY DEVICE

The present invention claims the benefit of Korean Patent Application No. P2002-42973 filed in Korea on Jul. 22, 2002, which is hereby incorporated by reference.

BACKGROUND OF THE INVENTION

1. Field of the Invention

The present invention relates to a method and a display apparatus, and more particularly to a driving method and a liquid crystal display apparatus.

2. Description of the Art

A liquid crystal display device displays images by controlling light transmittance of a liquid crystal material using an electric field. The liquid crystal display device comprises a liquid crystal display panel having a pixel matrix and a drive circuit for driving the liquid crystal display panel.

FIG. 1 is a block schematic diagram of a liquid crystal display device according to the related art. In FIG. 1, a liquid crystal display is connected to a system driver 1 installed in a computer system, and includes a graphic card 2 for supplying video data adapted to a liquid crystal display 3. The graphic card 2 converts the video data and supplies the converted video data to the liquid crystal display 3, wherein the video data includes red (R), green (G), and blue (B) video data. In addition, the graphic card 2 generates control signals that include a clock signal (DCLK) and horizontal and vertical synchronization signals (Hsync, Vsync) suitable for the resolution of the liquid crystal display 3.

The liquid crystal display 3 includes a liquid crystal display panel 10, a data driver 6 for driving data lines (D1 to Dm) of the liquid crystal display panel 10, a gate driver 8 for driving gate lines (G1 to Gn) of the liquid crystal display panel 10, a timing controller 4 for controlling a drive timing of the data and the gate drivers 6 and 8, a power supply circuit 14 generating a driving voltage necessary to drive the liquid crystal display 3, and a gamma circuit 12 supplying a gamma voltage to the data driver 6.

The power supply circuit 14 generates driving voltages necessary for driving the liquid crystal display 3 (i.e., gate high voltage, gate low voltage, gamma reference voltage, and common voltage) using the voltage received from a system power supply (not shown) of the system driver 1. Accordingly, the power supply circuit 14 supplies the driving voltages to the timing controller 4, the data driver 6, the gate driver 8, and the gamma circuit 12.

The liquid crystal display panel 10 is connected to a thin film transistor (TFT) formed at each intersection of an n-number of the gate lines (G1 to Gn) and an m-number of the data lines (D1 to Dm) and includes liquid crystal cells connected to the respective thin film transistor and arranged in a matrix pattern. The thin film transistor supplies video data from the data lines (D1 to Dm) to the liquid crystal cell in response to gate signals from the gate lines (G1 to Gn). Since the liquid crystal cell comprises a pixel electrode connected to a common electrode and a thin film transistor facing each other in which a liquid crystal is located thereto, the liquid crystal display is equivalently expressed as a liquid crystal capacitor (Clc). The liquid crystal cell includes a storage capacitor (Cst) connected to a pre-staged gate line in order to maintain the data voltage charged to the liquid crystal capacitor (Clc) until the next data voltage is received.

The gate driver 8 sequentially supplies the gate high voltage signal to the gate lines (G1 to Gn) according to a gate start pulse signal (GSP) received from the timing controller 4. Accordingly, the gate driver 8 includes a plurality of gate drive integrated circuits (not shown), commonly referred to as gate driving ICs, for separately and sequentially driving the gate lines (G1 to Gn). Each of the gate driving ICs include a shift register responding to the gate start pulse signal (GSP) and a gate shift clock signal (GSC) provided from the timing controller 4. In addition, the gate driving ICs sequentially generate a gate high voltage signal and include a level shifter for shifting voltages of the gate high voltage signal to suitable levels for driving the thin film transistor. When the gate start pulse signal (GSP) is supplied from the timing controller 4, the gate driving ICs respond to the gate shift clock signal (GSC) and sequentially supplies the gate high voltage signal having one horizontal period (1H) to the gate lines (G1 to Gn) by performing a shift operation.

The data driver 6 converts the R, G, and B data signals from the timing controller 4 into analog signals and supplies the video data of one horizontal line for each horizontal period in which the gate high voltage signal is supplied to the gate line (G1 to Gn) to the data lines (DL1 to DLm). Accordingly, the data driver 6 includes a shift register part supplying sequential sampling signals, a latch part providing signals at the same time as sequentially latching the video data in response to the sampling signal, a digital-analog converter part converting the digital video data from latch part into analog video data, and an output buffer part providing signals as buffering the analog video data from the digital-analog converter part. Positive and negative gamma voltages are set in order to have voltage levels different from each other according to the voltage level of the video data from gamma circuit 12 in a digital-analog converter part of the data driver 6. As the positive and the negative gamma voltages are supplied to the video data, the video data adapts gamma characteristics that are selected by a polarity inversion signal (POL) from the timing controller 4 and is supplied to the data lines (D1 to Dm) in response to a source output enable signal (SOE).

In order to drive the liquid crystal display panel 10, the timing controller 4 responds to a clock signal and horizontal and vertical synchronization signals (Hsync, Vsync) from the graphic card 2, and controls driving timing of the gate driver 8 and the data driver 6. For example, the timing controller 4 responds to the clock signal and the horizontal and the vertical synchronization signals (Hsync, Vsync), generates a gate clock signal, a gate control signal, and a gate start pulse, and supplies the signals to the gate driver 8. In addition, the timing controller 4 responds to an input clock signal and horizontal and vertical synchronization signals (Hsync, Vsync), and generates a data enable signal and supplies the signals to the data driver 6. Moreover, the timing controller 4 supplies the R, G, and B video data from the graphic card 2 to the data driver 6 in synchronization with the polarity inversion signal and the data enable signal.

During driving of the liquid crystal panel 10, since the thin film transistor (TFT) is turned ON by the gate high voltage (Vgh) supplied to the gate line (G), video voltage signals supplied to the data lines (DL1 to DLm) are charged to the liquid crystal capacitor (Clc). Subsequently, since the thin film transistor is turned OFF by the gate low voltage (Vgl) supplied to the gate line (G), the video voltage charged to the liquid crystal capacitor (Clc) is maintained until the next data voltage is supplied. Accordingly, when the gate high voltage (Vgh) and the gate low voltage (Vgl) are supplied to a pre-staged gate line (Gn-1), the storage capacitor (Cst) connected in parallel to the liquid crystal capacitor (Clc) is charged and maintains the charged voltage higher than voltage charged to the liquid crystal capacitor during a turned OFF period. Thus, fluctuations of the voltages charged to the liquid crystal capacitor (Clc) can be minimized.

In order to drive the liquid crystal cells of the liquid crystal display panel, various inversion driving methods, such as frame inversion, line-column inversion, and dot inversion, are commonly used in the liquid crystal display device. During the frame inversion driving method, the polarity of the data signal supplied to the liquid crystal cells of the liquid crystal display panel is inverted whenever a frame is changed. During the line-column inversion method, the polarity of the data signal supplied to the liquid crystal cells is inverted according to the line (column) of the liquid crystal display panel. During the dot inversion method, a data signal is supplied to each liquid crystal cell of the liquid crystal display panel, wherein the data signal has a polarity contrary to the data signal supplied to adjacent liquid crystal cells along vertical and horizontal directions. In addition, during the dot inversion method, the polarity of the data signals supplied to all the liquid crystal cells of the liquid crystal display panel are inverted for each frame. Among the various inversion driving methods, the dot inversion method provides excellent picture quality, as compared to the frame and line-column inversion methods. Driving of the frame and line-column inversion methods is carried out as the data driver 6 responds to the polarity inversion signal supplied to the data driver 6 from the timing controller 4.

In general, liquid crystal display devices are commonly driven at a frame frequency of 60 Hz. However, in devices, such as a notebook computer, requiring low power consumption, the frame frequency is lowered to 50~30 Hz, thereby creating a flicker phenomenon during the dot inversion method. Accordingly, a 2-dot inversion method is used to drive the liquid crystal display panel.

FIGS. 2A and 2B are diagrams showing 2-dot inversion polarity patterns applied to the liquid crystal display panel of FIG. 1 according to the related art. In FIGS. 2A and 2B, the polarities of data signals are supplied to liquid crystal cells of the liquid crystal display panel using a two-dot inversion method having odd- and even-numbered frames. In the odd- and even-numbered frames, the polarity of the data signal is inverted by the liquid crystal cell similar to the dot inversion system along a horizontal direction, but is inverted by the 2-dots along a vertical direction.

FIGS. 3A and 3B are diagrams showing additional 2-dot inversion polarity patterns applied to the liquid crystal display panel of FIG. 1 according to the related art. In FIGS. 3A and 3B, the polarities of data signals are supplied to liquid crystal cells of the liquid crystal display panel using a 2-dot inversion method including odd-and even-numbered frames. In the odd- and even-numbered frames, the polarity of the data signal is inverted by the liquid crystal cell similar to the dot inversion system along a horizontal direction, but is inverted by 2-dots along a vertical direction except for a first horizontal line.

FIG. 4 is a waveform diagram of polarity inversion signals applied to a data driver of the liquid crystal display panel of FIG. 1 according to the related art. In order to drive the liquid crystal display using the 2-dot inversion method, the timing controller 4 generates the polarity inversion signal (POL) for the liquid crystal cell driven by the 2-dot inversion method using the vertical synchronization signal (Vsync) and the horizontal synchronization signal (Hsync) received from the graphic card 2. In addition, the timing controller 4 generates the data enable signal (DE) for supplying the data signal to the liquid crystal cell using of the vertical synchronization signal (Vsync) and the horizontal synchronization signal (Hsync) received from the graphic card 2. The data enable signal (DE) generated by the timing controller 4 is divided into a back porch period, which spans from the last point of time of the vertical synchronization signal (Vsync) to the starting point of time of the data enable signal (DE), and an effective data period when effective data is supplied during one vertical synchronization period. Accordingly, the back porch period is a period between a rising edge of the data signal at the first data line, after the vertical synchronization signal (Vsync) is over, among a blanking period in which effective data does not exist in one frame driven by the one vertical synchronization signal (Vsync). Furthermore, the polarity of the polarity inversion signal (POL) generated by the timing controller 4 is inverted by the two horizontal synchronization signals (Hsync) during the period of the vertical synchronization signal (Vsync).

FIG. 5 is a circuit diagram of a polarity inversion signal generator for generating the polarity inversion signals of FIG. 4 according to the related art. In FIG. 5, the timing controller 4 includes a polarity inversion signal generator 30 having a first D flip-flop (DF1) supplying a first frequency division to the horizontal synchronization signal (Hsync), a second D flip-flop (DF2) supplying a second frequency division to an output from an inverted output terminal (BQ1) of the first D flip-flop (DF1), a reset circuit 32 for resetting frames of logic states of the first and the second D flip-flop (DF1, DF2), and a multiplexer for selecting an input signal supplied from a non-inversion output terminal (Q2) and an inverted output terminal (BQ2) of the second D flip-flop (DF2) to supply the selected input signal to the data driver.

In FIG. 5, the first D flip-flop (DF1) receives the inverted horizontal synchronization signal (Hsync) as a clock signal to supply the first frequency division to the received signal to provide the frequency-divided signal. The second D flip-flop (DF2) supplies the second frequency division to the input signal from the first D flip-flop (DF1) to provide the frequency-divided signal. For example, the second D flip-flop (DF2) supplies frequency-division twice to the horizontal synchronization signal (Hsync).

FIG. 6 is a waveform diagram of polarity inversion signals applied to a data driver according to the related art. In FIG. 6, the first D flip-flop (DF1) synchronizes a signal, which is fed-back from its own inversion output terminal (BQ1) and is received at an input terminal (D), with the rising edge of the inverted horizontal synchronization signal (Hsync) to generate a first polarity inversion signal (POL1), thereby supplying the generated first polarity inversion signal (POL1) to the clock input terminal of the second D flip-flop (DF2) through the inversion output terminal (BQ1). Accordingly, the first polarity inversion signal (POL1) is inverted in polarity for each falling edge of the horizontal synchronization signal (Hsync).

In FIG. 6, the second D flip-flop (DF2) synchronizes a signal, which is fed-back from its own inversion output terminal (BQ2) and is received at an input terminal (D), with the rising edge of the first polarity inversion signal (POL1) from the inversion output terminal (BQ1) of the first D flip-flop (DF1) to generate a second polarity inversion signal (POL2). Accordingly, the second polarity inversion signal (POL2) is inverted in polarity for each second period of the horizontal synchronization signal (Hsync). In addition, the second polarity inversion signal (POL2) generated at the second D flip-flop (DF2) is supplied to a first input terminal of the multiplexer (MUX) through the non-inversion output terminal (Q2) and is supplied to a second input terminal of the multiplexer (MUS) through the inversion output terminal (BQ2).

In FIG. 5, the reset circuit 32 includes a fourth D flip-flop (DF4) delaying the vertical synchronization signal (Vsync) received in response to the clock signal (CLK) by one clock period, a fifth D flip-flop (DF5) delaying the input signal from non-inversion output terminal of the fourth D flip-flop (DF4) by one clock period in response to the clock signal (CLK), an XOR gate 34 for Exclusive-OR-Logic operation between the input signal from non-inversion output terminal (Q5) of the fifth D flip-flop (DF5) and the vertical synchronization signal (Vsync), and a NAND gate for NAND-Logic operation between the output signal (Q6) from XOR gate 34 and the vertical synchronization signal (Vsync). The reset circuit 32 generates the reference to the horizontal synchronization signal (Hsync) in order to invert the vertical synchronization signal (Vsync) for each frame. In addition, the polarity inversion signal (POL2) of 2 dot inversion system is generated by the first and the second D flip-flops (DF1, DF2) including a reset signal (VSRB) for resetting the logic states of the first and the second D flip-flops (DF1, DF2) for each frame on the basis of the vertical synchronization signal (Vsync).

The multiplexer MUX selects input signals provided to each of the first and the second input terminals from the inverted output terminal (BQ2) and the non-inverted output terminal (Q2) of the second D flip-flop (DF2), and supplies the selected signal to the data driver 6 (in FIG. 1). Accordingly, the reset circuit 30 includes a third D flip-flop (DF3) that generates a selection signal (CS) inverted for each frame unit and is connected to a selection signal input terminal of the multiplexer MUX. The third D flip-flop (DF3) receives a feedback signal from its own inverted output terminal (BQ3) synchronized at a rising edge of the inverted vertical synchronization signal (Vsync), and generates and supplies the selection signal (CS) to the selection signal input terminal of the multiplexer MUX through a non-inverted output terminal (Q3). Since the selection signal is generated on the basis of the vertical synchronization signal (Vsync), the selection signal (CS) is inverted for each frame. Accordingly, the multiplexer MUX performs an inversion in response to the second polarity inversion signal (POL2) for each selection signal (CS) from the third D flip-flop (DF3) and supplies the inverted signal to the data driver 6.

FIG. 7 is a schematic circuit diagram of a MUX part of a data driver according to the related art. In FIG. 7, the data driver 6 (in FIG. 1) supplies the polarity of the video data to the liquid crystal display panel 10 (in FIG. 1) using the 2-dot inversion method according to the polarity inversion signal (POL2) received from the timing controller 4 (in FIG. 1) using a plurality of multiplexers 52. Accordingly, each of the multiplexers 52 of the data driver 6 (in FIG. 1) includes first and second input terminals to which positive (+) and negative (−) data voltages are supplied from a digital-analog converter (not shown), a selection signal input terminal to which the polarity inversion signal (POL2) received from the timing controller 4 (in FIG. 1) is supplied, and an output terminal connected to the data lines (DL1 to DLm) through a buffer (not shown). In FIG. 7, an inverter 54 is connected to the selection signal input terminal of even-numbered ones of the multiplexers 52 for inverting the polarity inversion signal (POL2) received from the timing controller 4 (in FIG. 1).

Accordingly, the polarity of the video data supplied to the liquid crystal display panel 10 from the data driver 6 (in FIG. 1), as shown in FIGS. 2A, 2B, 3A, and 3B, are converted to have the polarity using the 2-dot inversion method since a start point of time of the polarity inversion signal (POL2) differs according to the number of the horizontal synchronization signal (Hsync) received during the back porch period of the data enable signal (DE).

When the number of the horizontal synchronization signal (Hsync) received to the back porch period of the data enable signal (DE) is even numbered, the polarity of the effective video data of the data enable signal (DE) is supplied to the liquid crystal display panel 10 using the 2-dot inversion method, as shown in FIGS. 2A and 2B, according to the second polarity inversion signal (POL2) beginning from a point "A" of time of the second polarity inversion signal (POL2), as shown in FIG. 6. Furthermore, when the number of the horizontal synchronization signal (Hsync) received to the back porch period of the data enable signal (DE) is odd numbered, the polarity of the effective video data of the data enable signal (DE) is supplied to the liquid crystal display panel 10 using the 2-dot inversion method, as shown in FIGS. 3A and 3B, according to the second polarity inversion signal (POL2) beginning from a point "B" of time of the second polarity inversion signal (POL2), as shown in FIG. 6.

FIGS. 8A and 8B are diagrams showing flicker inspection patterns of a 2-dot inversion system according to the related art. In FIG. 8A, during the 2-dot inversion driving method, a flicker inspection pattern (i.e., the first flicker inspection pattern) shows that the polarity of data supplied to the liquid crystal display panel is changed by a 1-dot unit along a horizontal direction and is changed by a 2-dot unit along a vertical direction and is supplied as a half-gray pattern to a green sub-pixel of the negative polarity (−), and a black pattern to red and blue sub-pixels. Accordingly, if the first flicker inspection pattern is displayed on the liquid crystal display panel driven using the 2-dot inversion method, the flicker can be adjusted since components of a ½-frame frequency, i.e., frame frequency divided in half, appear due to the half-gray pattern of the negative polarity (−).

In FIG. 8B, during the 2-dot inversion driving method, the flicker inspection pattern (i.e., the second flicker inspection pattern) shows that the polarity of data supplied to the liquid crystal display panel is changed by a 1-dot unit along a horizontal direction and is changed by a 2-dot unit along a vertical direction except for a first horizontal direction that supplies a half-gray pattern to a green sub-pixel of the negative polarity (−), and a black pattern to red and blue sub pixels. Accordingly, if the second flicker inspection pattern is displayed on the liquid crystal display panel driven using the 2-dot inversion method, the flicker can be adjusted since components of a ½-frame frequency, i.e., frame frequency divided in half, appear due to the half-gray pattern of the negative polarity (−).

FIGS. 9A and 9B are diagrams showing flicker inspection patterns according to the related art. In FIG. 9A, inspection of a flicker adjustment for the liquid crystal display using the 2-dot inversion driving method includes adjusting the flicker by a first flicker inspection pattern (a) using the 2-dot inversion method (b), wherein the data polarity is changed by the 1-dot unit along the horizontal direction and is changed by the 2-dot unit along the vertical direction except for the first horizontal direction. Accordingly, a flicker inspection pattern (c) is produced, wherein the positive polarity (+) and the negative polarity (−) are offset from each other. Thus, flicker cannot be seen on the liquid crystal display panel due to the frame frequency component, and the flicker cannot be adjusted.

In FIG. 9B, inspection of a flicker adjustment for the liquid crystal display using the 2-dot inversion driving method includes adjusting the flicker by a first flicker inspection pattern (a) using the 2-dot inversion method (b), wherein the data polarity is changed by the 1-dot unit along the horizontal direction and is changed by the 2-dot unit along the vertical direction except for the first horizontal direction. Accordingly, a flicker inspection pattern (c) is produced, wherein the positive polarity (+) and the negative polarity (−) are offset from each other. Thus, flicker cannot be seen on the liquid crystal display panel due to the frame frequency component, and the flicker cannot be adjusted.

Accordingly, with respect to the driving method of the liquid crystal display using the 2-dot inversion driving method, since the polarity inversion signal (POL2) supplied to the data driver 6 becomes different according to the number of the horizontal synchronization signal received to the back porch period of the data enable signal (DE), the data polarity of the 2-dot inversion method supplied to the liquid crystal display panel 10 becomes different.

SUMMARY OF THE INVENTION

Accordingly, the present invention is directed to a method and an apparatus for driving a liquid crystal display device that substantially obviates one or more of the problems due to limitations and disadvantages of the related art.

An object of the present invention to provide a driving method and a driving apparatus of a liquid crystal display device for generating a polarity inversion signal identical to a data polarity of a 2-dot inversion method supplied to a liquid crystal display panel irrespective of the number of horizontal synchronization signals supplied for a back porch period in the 2-dot inversion method.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a driving apparatus for a liquid crystal display device includes a liquid crystal display panel having a plurality of data lines and gate lines arranged in a matrix configuration, a data driver for supplying video data to the data lines, a gate driver for supplying gate pulses to the gate lines, and a timing controller for controlling polarity of the video data by supplying a polarity inversion signal to the data driver and controlling a timing of the data driver and the gate driver according to a number of horizontal synchronization signals supplied during a data blanking period, wherein a plurality of the polarity inversion signals are different from each other.

In another aspect, a driving method of a liquid crystal display device comprising a liquid crystal display panel having a plurality of data lines and gate lines arranged in a matrix configuration, a data driver for supplying video data to the data lines, and a gate driver for supplying gate pulses to the gate lines, includes generating first and second polarity inversion signals different from each other according to a number of horizontal synchronization signals supplied during a data blanking period, and controlling a polarity of the video data by supplying the first and the second polarity inversion signals to the data driver.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIGS. 2A and 2B are diagrams showing 2-dot inversion polarity patterns applied to the liquid crystal display panel of FIG. 1 according to the related art;

FIGS. 3A and 3B are diagrams showing additional 2-dot inversion polarity patterns applied to the liquid crystal display panel of FIG. 1 according to the related art;

FIGS. 9A and 9B are diagrams showing flicker inspection patterns according to the related art;

FIGS. 16A and 16B are diagrams showing an exemplary 2-dot inversion signal patterns applied to the liquid crystal display device of FIG. 10 according to the present invention;

FIGS. 17A and 17B are diagrams showing additional exemplary 2-dot inversion signal patterns applied to the liquid crystal display device of FIG. 10 according to the present invention;

FIG. 18 is a diagram showing an exemplary flicker inspection pattern according to the present invention; and FIG. 19 is a diagram showing another exemplary flicker inspection pattern according to the present invention.

DETAILED DESCRIPTION OF THE PREFERRED EMBODIMENTS

Reference will now be made in detail to the preferred embodiments of the present invention, examples of which are illustrated in the accompanying drawings.

Figure 1:
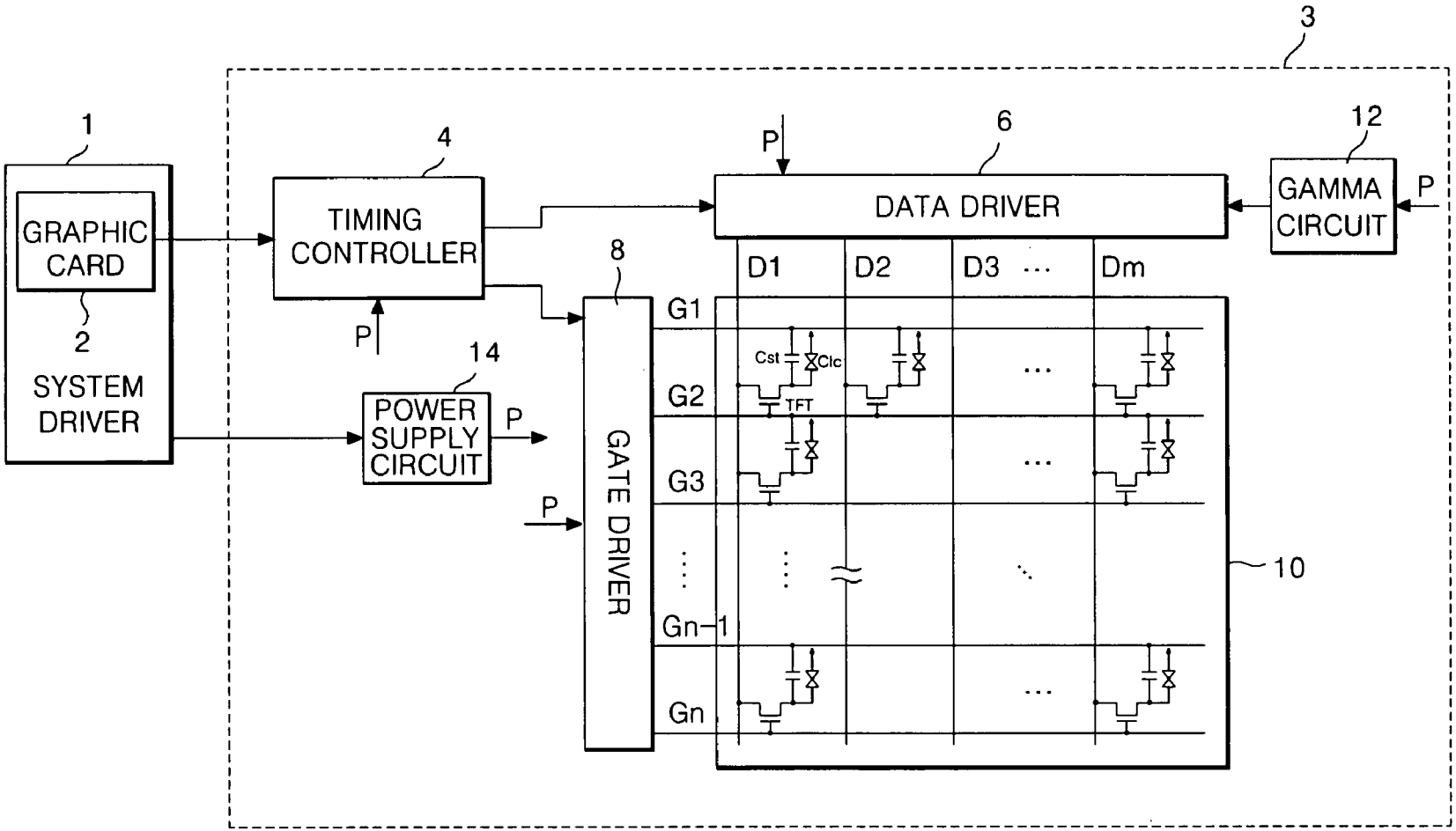
FIG. 1 RELATED ART
FIG. 1 is a block schematic diagram of a liquid crystal display device according to the related art.
Figure 4:
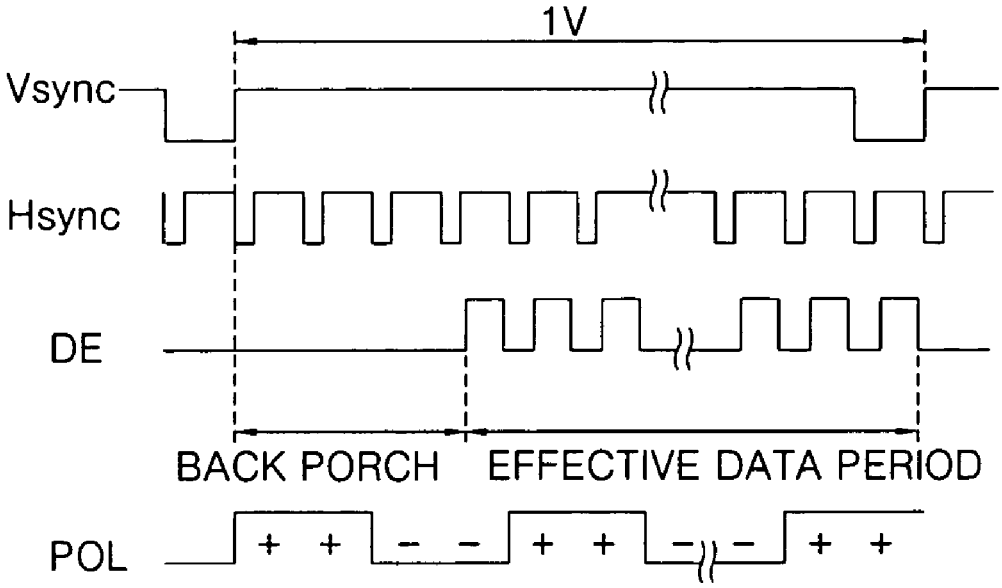
FIG. 4 RELATED ART
FIG. 4 is a waveform diagram of polarity inversion signals applied to a data driver of the liquid crystal display panel of FIG. 1 according to the related art.
Figure 5:
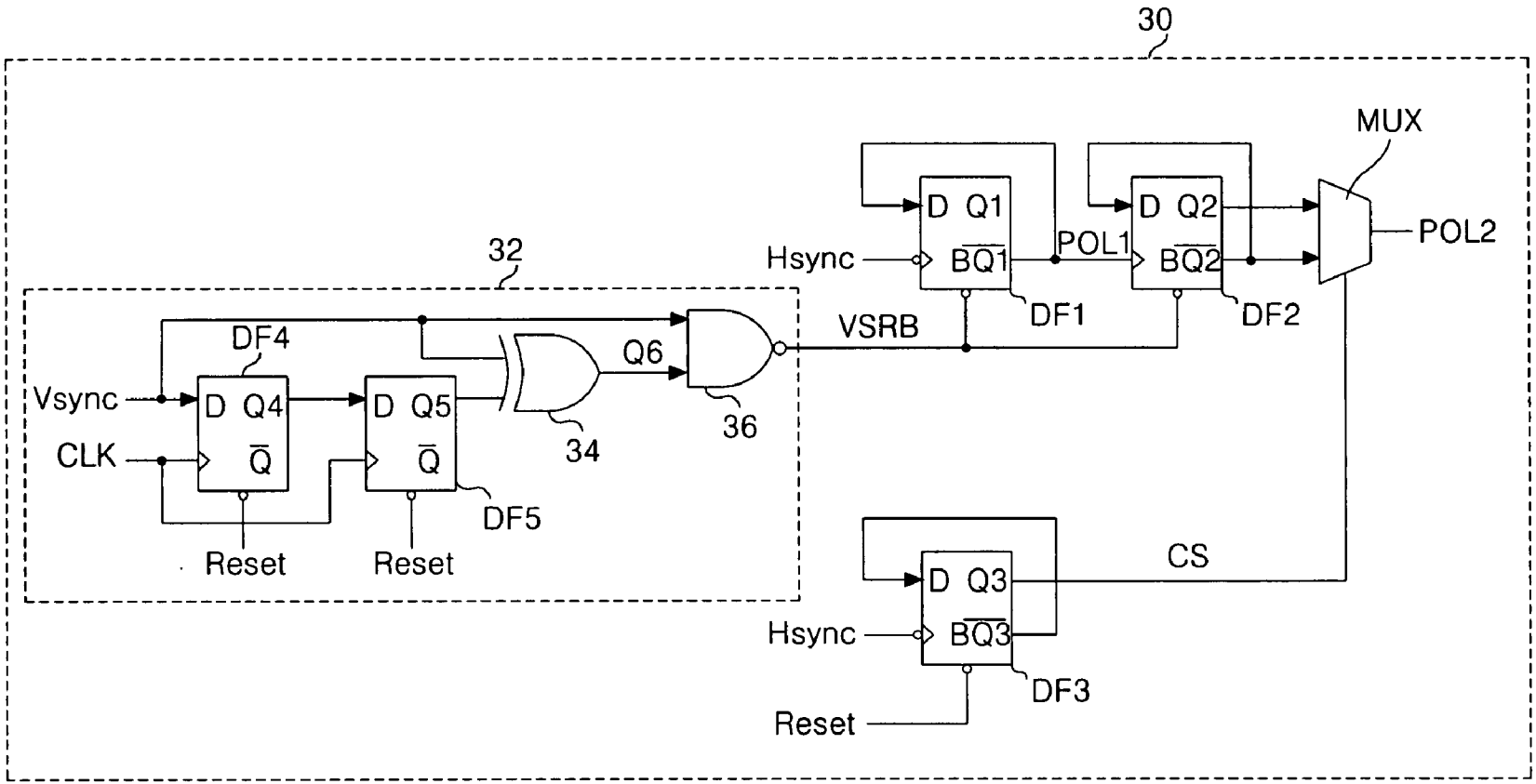
FIG. 5 RELATED ART
FIG. 5 is a circuit diagram of a polarity inversion signal generator for generating the polarity inversion signals of FIG. 4 according to the related art.
Figure 6:
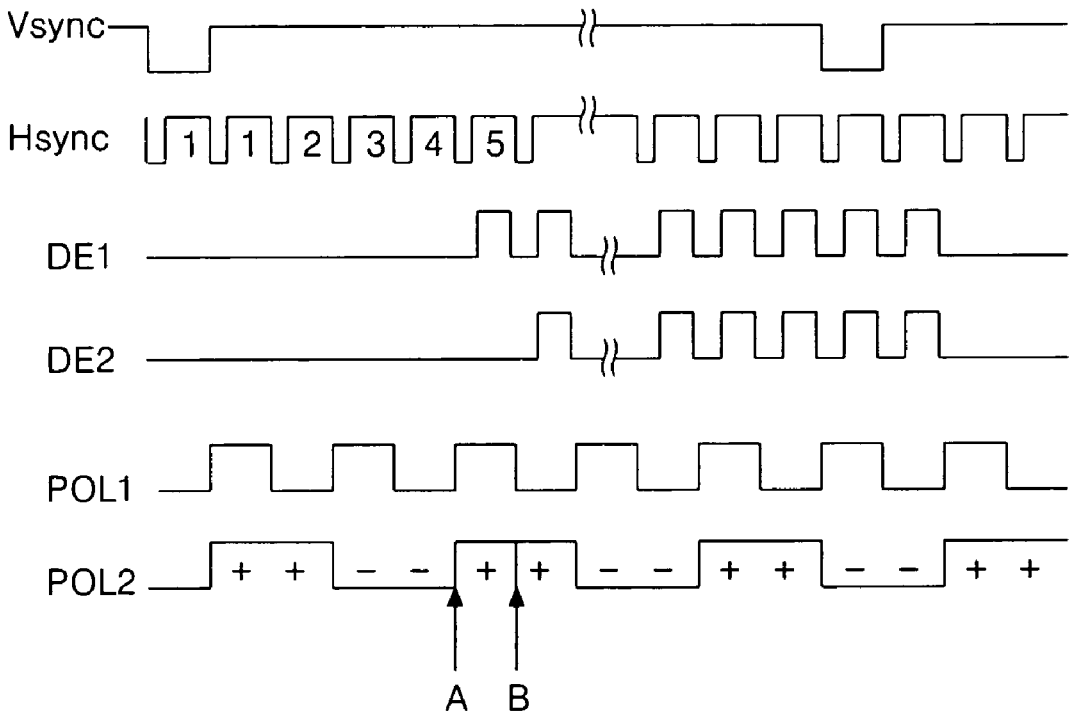
FIG.6 RELATED ART
FIG. 6 is a waveform diagram of polarity inversion signals applied to a data driver according to the related art.
Figures 7, 8A, 8B:
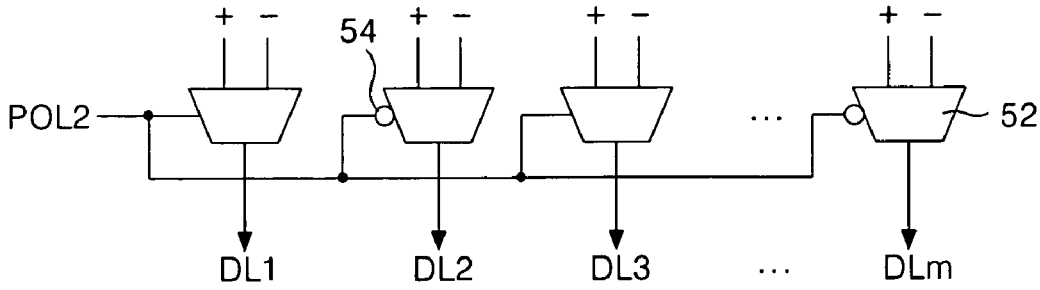
FIG.7 RELATED ART
FIG.8A RELATED ART
FIG.8B RELATED ART
FIG. 7 is a schematic circuit diagram of a MUX part of a data driver according to the related art.
FIGS. 8A and 8B are diagrams showing flicker inspection patterns of a 2-dot inversion system according to the related art.
Figure 10:
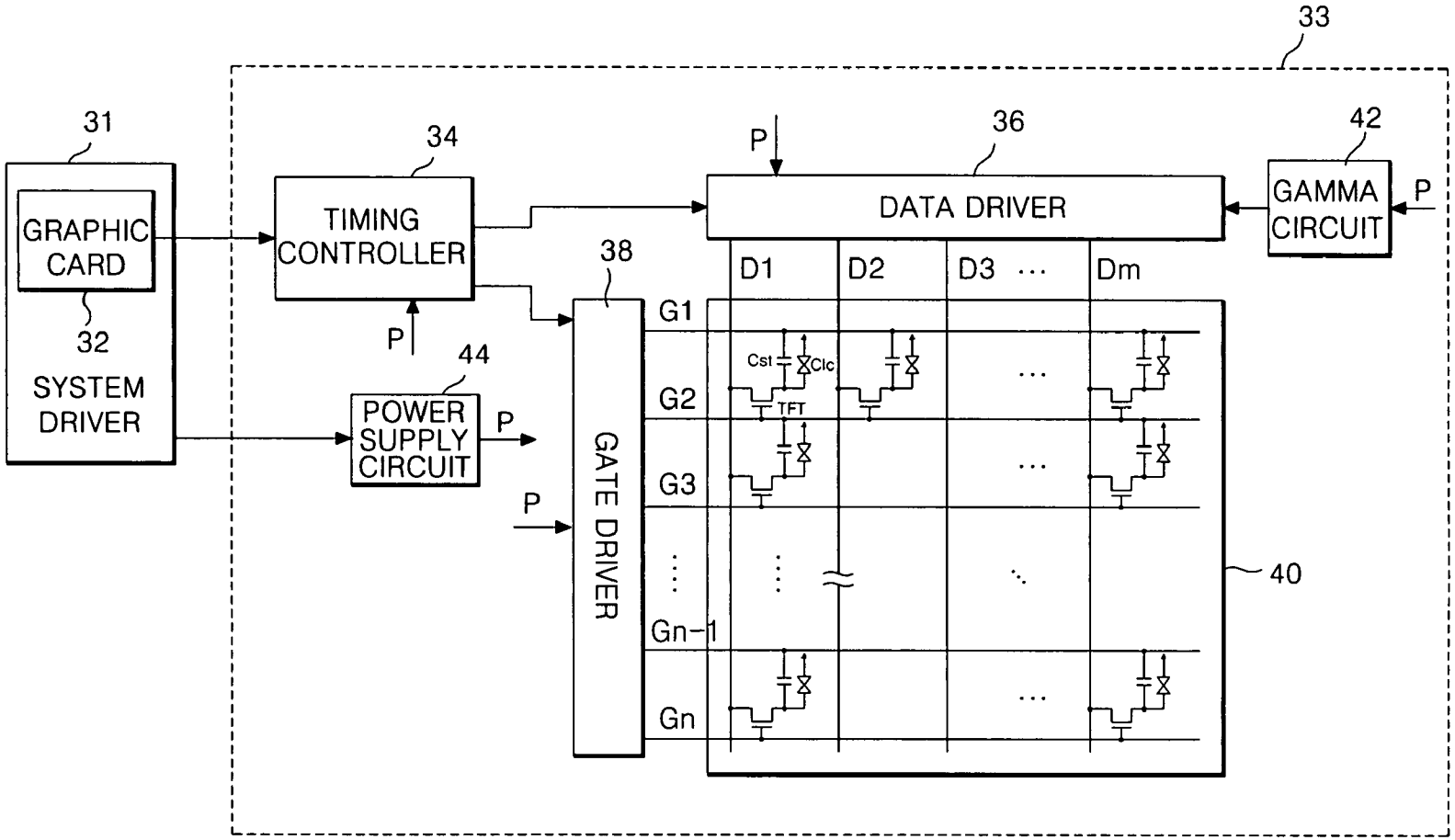
FIG. 10 is a block schematic diagram of an exemplary liquid crystal display device according to the present invention.

FIG. 10 is a block schematic diagram of an exemplary liquid crystal display device according to the present invention. In FIG. 10, a liquid crystal display 33 may include a liquid crystal display panel 40, a data driver 36 for driving data lines (D1 to Dm) of the liquid crystal display panel 40, a gate driver 38 for driving gate lines (G1 to Gn) of the liquid crystal display panel 40, a timing controller 34 for controlling driving timing of the data and the gate drivers 36 and 38, a power supply circuit 44 generating driving voltage (P) to drive the liquid crystal display 33, and a gamma circuit 42 supplying a gamma voltage to the data driver 36. In addition, the liquid crystal display 33 may be connected to a system driver 31 that may be mounted in a controller system, i.e., a computer system.

The system driver 31 may include a graphic card 32 for supplying a video data adapted to the liquid crystal display 33, wherein the graphic card 32 may convert the video data supplied thereto and may provide the converted video data to the liquid crystal display 33. The video data may include red (R), green (G), and blue (B) data signals. In addition, the graphic card 32 may generate control signals including a clock signal (DCLK) and horizontal and vertical synchronization signals (Hsync, Vsync).

The power supply circuit 44 may generate driving voltages P for driving the liquid crystal display 33 (i.e., gate high voltage, gate low voltage, gamma reference voltage, and common voltage) received from the system driver 31 and may supply the driving voltages P to the timing controller 34, the data driver 36, the gate driver 38, and the gamma circuit 42.

The liquid crystal display panel 40 may include thin film transistors (TFTs) each formed at each intersection of an n-number of the gate lines (G1 to Gn) and an m-number of the data lines (D1 to Dm), and may include liquid crystal cells arranged in a matrix configuration. The thin film transistors may respond to gate signals from the gate lines (G1 to Gn) and may supply video data from the data lines (D1 to Dm) to the liquid crystal cells. Since each of the liquid crystal cells may include a pixel electrode, which is connected to one of the TFTs, and a common electrode with a liquid crystal material provided therebetween, the liquid crystal display may be equivalently represented as a liquid crystal capacitor (Clc). Accordingly, the liquid crystal cell may include a storage capacitor (Cst) connected to a pre-staged gate line to maintain a data voltage charged to the liquid crystal capacitor (Clc) until a next data voltage is charged.

The gate driver 38 may sequentially supply the gate high voltage signal to the gate lines (G1 to Gn) according to a gate start pulse (GSP) received from the timing controller 34. Accordingly, the gate driver 38 may include a plurality of gate driving integrated circuits (not shown) for sequentially and separately driving the gate lines (G1 to Gn). Each of the gate driving integrated circuits may include a shift register that responds to a gate start pulse (GSP) and a gate shift clock (GSC) provided from timing controller 34 and generating a sequential gate high voltage signal and a level shifter for shifting the voltage of the gate high voltage signal to a level for driving the thin film transistor. If the gate start pulse (GSP) is supplied from the timing controller 34, the gate driving integrated circuits may respond to the gate shift clock (GSC) and may supply the gate high voltage signal of one horizontal period (1H) sequentially to the gate lines (G1 to Gn) by performing a shift operation.

The gamma circuit 42 may supply preset positive and negative gamma voltages to the video data to generate a voltage level different from each other according to the voltage level of the video data, thereby providing video data representing a gamma characteristic.

The data driver 36 may convert the R, G, and B data signals received from the timing controller 34 into analog signals, and may supply the video data of one horizontal line for each horizontal period in which the gate high voltage signal is supplied to the gate line (G1 to Gn) to the data lines (DL1 to DLm).

In order to drive the liquid crystal display panel 40, the timing controller 34 may respond to a clock signal and horizontal and vertical synchronization signals (Hsync, Vsync) received from the graphic card 32, and may control driving timing of the gate driver 38 and the data driver 36. For example, the timing controller 34 may respond to the clock signal and the horizontal and the vertical synchronization signals (Hsync, Vsync) to generate a gate clock signal, a gate control signal, and a gate start pulse, and may supply the signals to the gate driver 38. Furthermore, the timing controller 34 may respond to an input clock signal and horizontal and vertical synchronization signals (Hsync, Vsync) to generate and supply a data enable signal to the data driver 36. In addition, the timing controller 34 may supply the R, G, and B video data received from the graphic card 32 to the date driver 36 in synchronization with the polarity inversion signal and the data enable signal.

During driving of the liquid crystal panel 40, since the thin film transistors (TFTs) may be turned ON by the gate high voltage (Vgh) supplied to the gate line (G), video voltage signal supplied to data lines (DL1 to DLm) may be charged to the liquid crystal capacitor (Clc). Subsequently, since the thin film transistor may be turned OFF by the gate low voltage (Vgl) supplied to the gate line (G), the video voltage charged to the liquid crystal capacitor (Clc) may be maintained until a next data voltage is supplied. Accordingly, when the gate high voltage (Vgh) and the gate low voltage (Vgl) are supplied to the pre-staged gate line (Gn-1), the storage capacitor connected in parallel to the liquid crystal capacitor (Clc) may be charged to maintain a voltage higher than a voltage charged to the liquid crystal capacitor during a turn-OFF period. Thus, during the turn-OFF period of the thin film transistor (TFT), fluctuations of the voltages charged to the liquid crystal capacitor (Clc) may be minimized.

Figure 11:
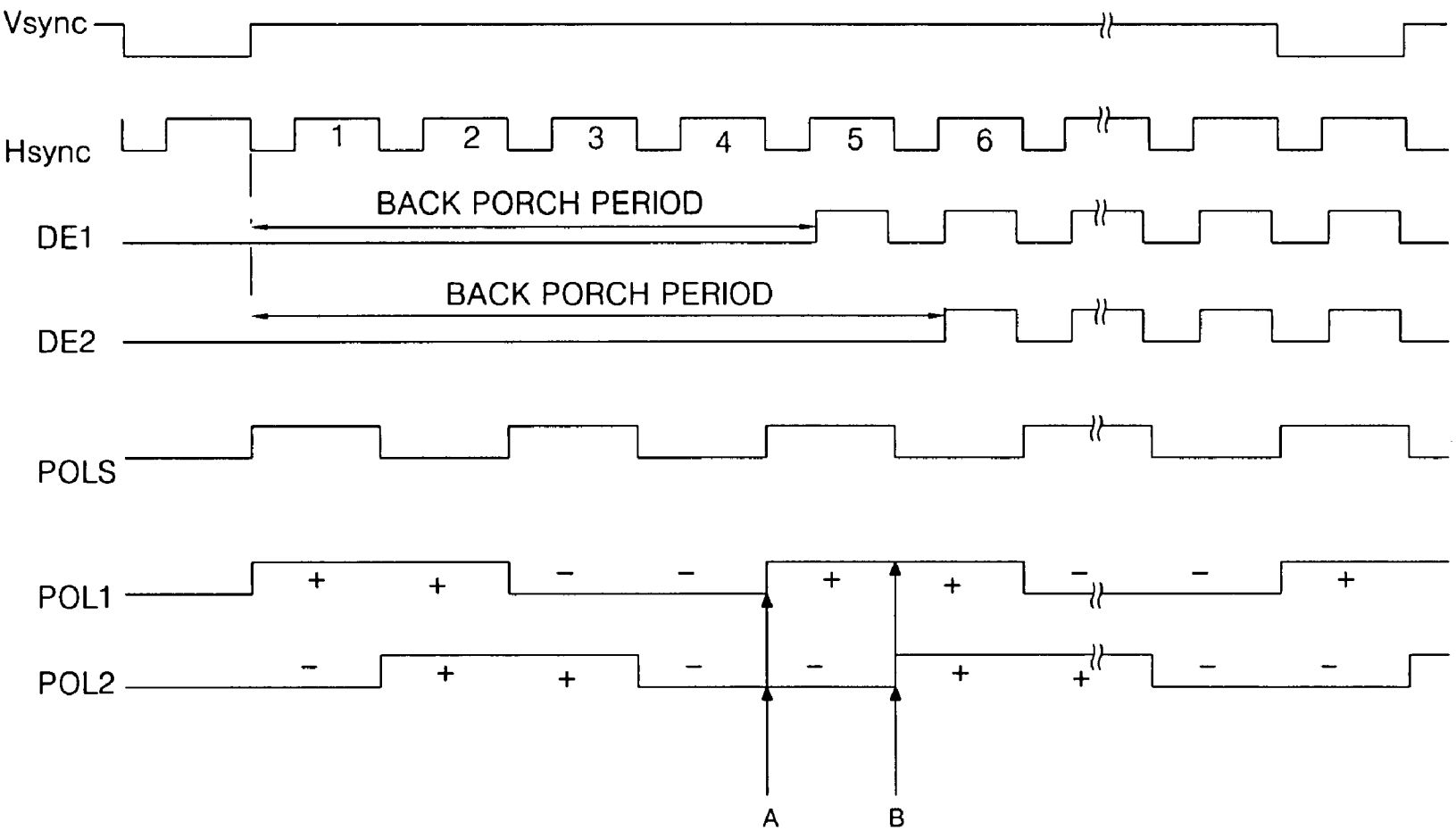
FIG. 11 is an exemplary waveform diagram of polarity inversion signals applied to a data driver of the liquid crystal display device of FIG. 10 according to the present invention.

FIG. 11 is an exemplary waveform diagram of polarity inversion signals applied to a data driver of the liquid crystal display device of FIG. 10 according to the present invention. In FIG. 11, during driving of the liquid crystal display using the 2-dot inversion method, the timing controller 34 may generate polarity inversion signals (POL1, POL2) to the liquid crystal cells using the vertical synchronization signal (Vsync) and the horizontal synchronization signal (Hsync) received from the graphic card 32. In addition, the data enable signal (DE) may be provided to supply the data signal to the liquid crystal cells using the vertical synchronization signal (Vsync) and the horizontal synchronization signal (Hsync).

The data enable signal (DE) generated by the timing controller 34 may be divided into a back porch period, which begins from a last point of time of the vertical synchronization signal (Vsync) to a starting point of time of the data enable signal (DE), and an effective data period where effective data is supplied during one vertical synchronization period. The back porch period is a period between a rising edge of the data signal at the first data line after the vertical synchronization signal (Vsync) is over, among a blanking period in which the effective data does not exist among one frame driven by the one vertical synchronization signal (Vsync). Furthermore, the polarity of the polarity inversion signals (POL1, POL2) generated by the timing controller 34 may be inverted by the two horizontal synchronization signal (Hsync) during the vertical synchronization signal (Vsync).

The polarity inversion signal (POLS) may be supplied from the timing controller 34 to the data driver 36, wherein odd- or even-numbered pulses of the horizontal synchronization signal (Hsync) supplied to the back porch period of the data enable signal (DE) may not be different during odd- or even-numbered time periods.

During a first inversion of a 2-dot inversion method, the polarity of data supplied to the liquid crystal display panel 40 may be changed by a 1-dot unit along a horizontal direction and may be changed by a 2-dot unit along a vertical direction, wherein the number of the horizontal synchronization signal (Hsync) may be supplied an even number of times during the back porch period of the data enable signal (DE), the data driver 36 may supply the polarity of data according to the first polarity inversion signal (POL1) from a point "A" of time of the first polarity inversion signal (POL1) supplied from the timing controller 34. In addition, during an odd-number of times, the data driver 36 may supply the polarity of data according to the second polarity inversion signal (POL2) from a point "B" of time of the second polarity inversion signal (POL2) supplied from the timing controller 34.

During a second inversion of a 2-dot inversion method, the polarity of data supplied to the liquid crystal display panel may be changed by a 1-dot unit along a horizontal direction and may be changed by a 2-dot unit along a vertical direction except for the first horizontal direction, when the number of the horizontal synchronization signal (Hsync) may be supplied an even number of times during the back porch period of the data enable signal (DE), the data driver 36 may supply the polarity of data according to a second polarity inversion signal (POL2) from a point "B" of time of the second polarity inversion signal (POL2) supplied from the timing controller 34. In addition, during an odd-number of times, the data driver 36 may supply the polarity of data according to the first polarity inversion signal (POL1) from the point "A" of time of the first polarity inversion signal (POL1) supplied from the timing controller 34.

Figure 12:
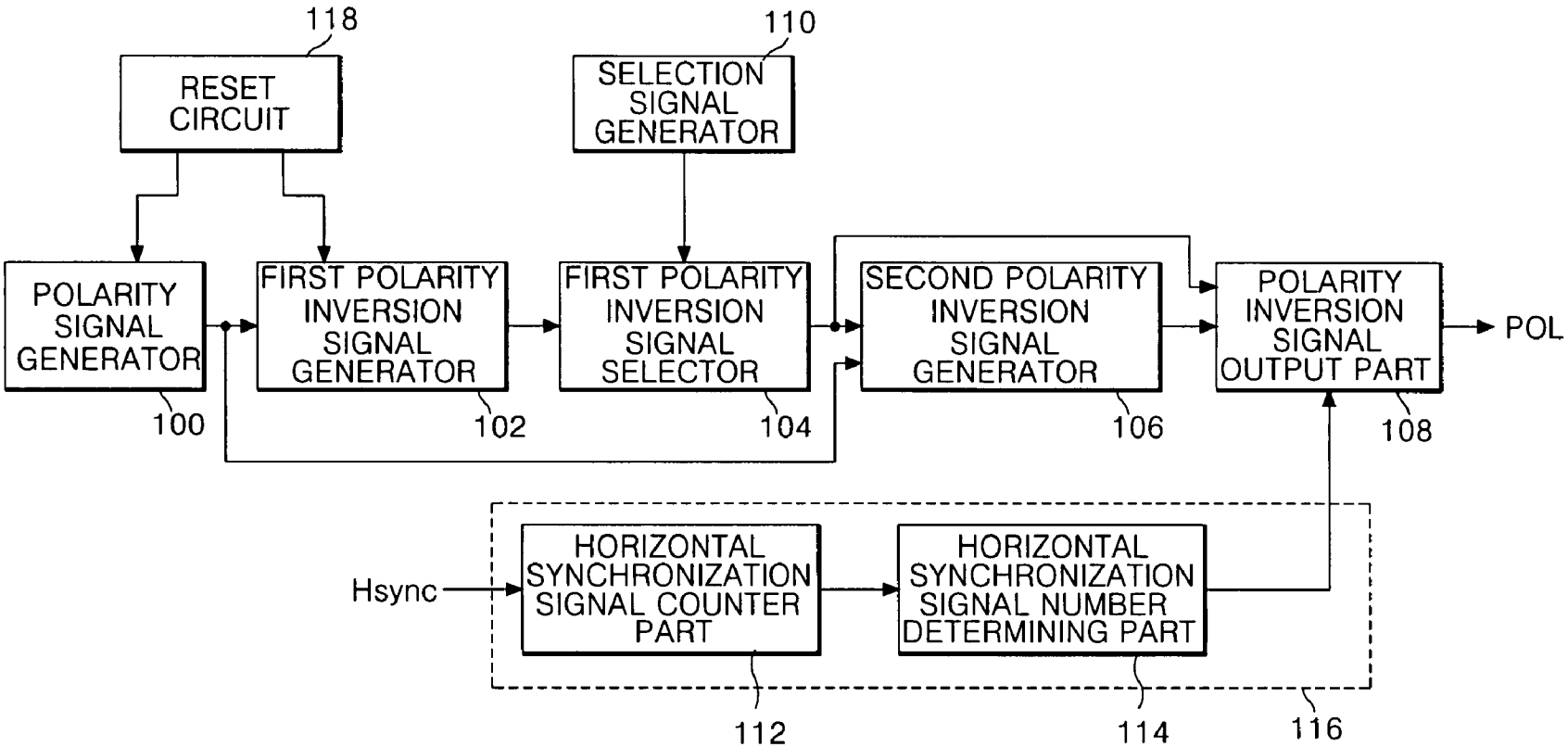
FIG. 12 is a block schematic diagram of an exemplary driving apparatus of a liquid crystal display device according to the present invention.
Figure 13:
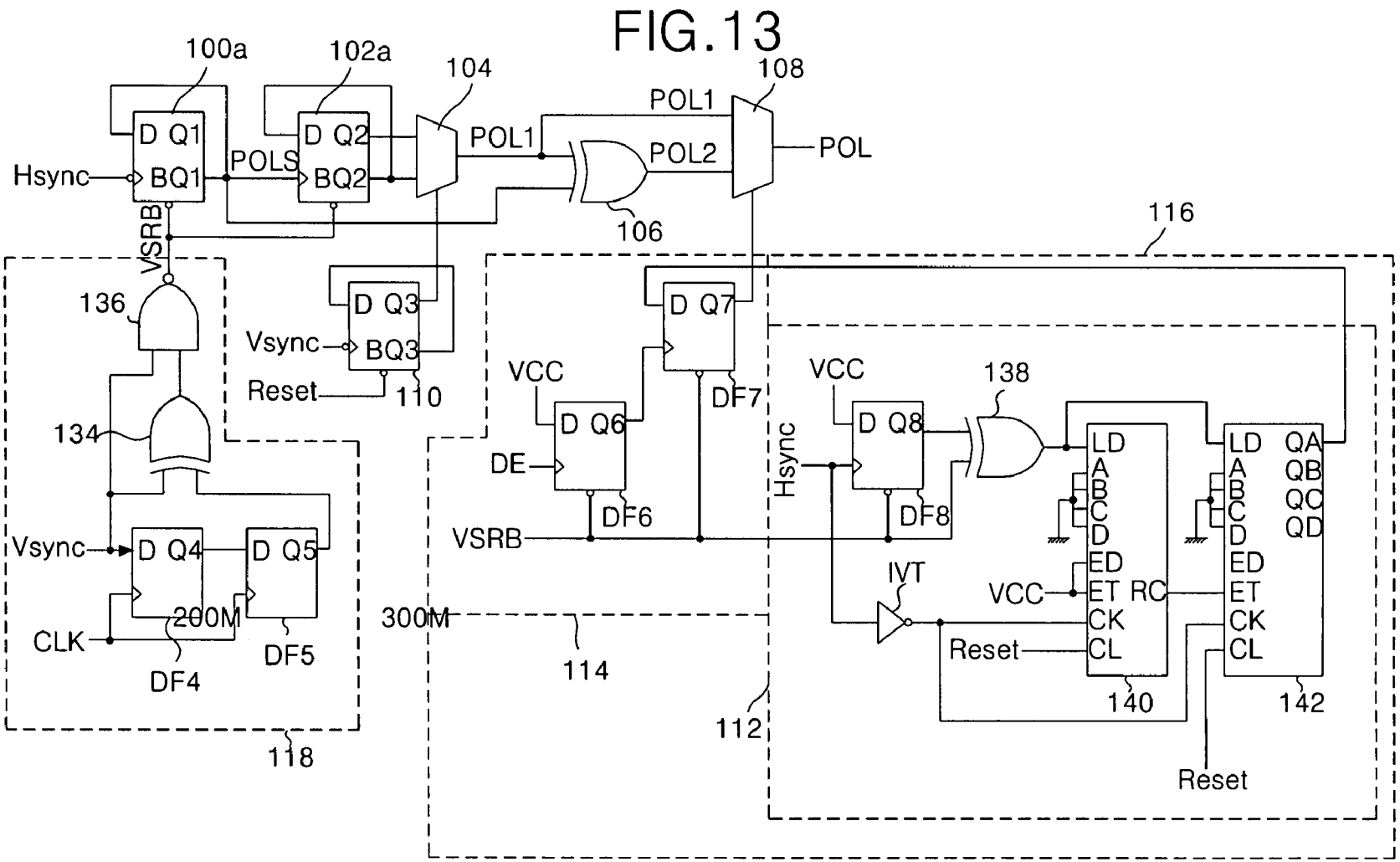
FIG. 13 is a schematic circuit diagram of an exemplary driving apparatus of a liquid crystal display device according to the present invention.

FIG. 12 is a block schematic diagram of an exemplary driving apparatus of a liquid crystal display device according to the present invention, and FIG. 13 is a schematic circuit diagram of an exemplary driving apparatus of a liquid crystal display device according to the present invention. In FIGS. 12 and 13, the timing controller 34 may include a polarity signal generator 100 for generating a polarity signal (POLS), a first polarity inversion signal generator 102 for generating the first polarity inversion signal (POL1) using the polarity signal (POLS) and for performing non-inversion and inversion of the first polarity inversion signal (POL1), a first inversion signal selector 104 for providing non-inverting and inverting the first polarity inversion signal (POL1) received from the first polarity inversion signal generator 102 during a frame-by-frame sequence, a second polarity inversion signal generator 106 generating the second polarity inversion signal (POL2) using the polarity signal (POLS) and the first polarity inversion signal (POL1), a determining part 116 for determining whether the number of the horizontal synchronization signal (Hsync) is an odd- or even-numbered time period during a vertical back porch period, and a polarity inversion signal output part 108 for supplying to the data driver 36 one of the first polarity inversion signal (POL1) received from the first polarity inversion signal selector 104 and the second polarity inversion signal (POL2) received from the second polarity inversion signal generator 106 according to the selection signal received from the determining part 116.

Accordingly, the polarity signal generator 100 of the timing controller 34 may include a first D flip-flop for executing one frequency division of the horizontal synchronization signal (Hsync) received from the graphic card 32. Accordingly, the first D flip-flop 100*a* may receive an inverted horizontal synchronization signal (Hsync) as a clock signal, may execute one frequency division to produce the polarity signal (POLS), and may supply the polarity signal (POLS) to the first polarity inversion signal generator 104.

The first polarity inversion signal generator 102 may include a second D flip-flop 102*a* for executing one frequency division to produce the polarity signal (POLS) received from the polarity signal generator 100. Accordingly, the second D flip-flop 102*a* may receive the polarity signal (POLS) as a clock signal, may execute a one frequency division, and may supply polarity signal (POLS) to the first polarity inversion signal selector 104.

During operation of the polarity signal generator 100 and the first polarity inversion signal generator 102, the first D flip-flop 100*a* receives feedback from its inverted output terminal (BQ1) at an input terminal (D) and is synchronized with a rising edge of the inverted horizontal synchronization signal (Hsync), and generates the polarity signal (POLS), as shown in FIG. 11, supplies the polarity signal (POLS) to a clock input terminal of the second D flip-flop 102*a* through the inverted output terminal (BQ1) and to the second polarity inversion signal generator 106. Accordingly, the polarity of the polarity signal (POLS) is inverted at every falling edge of the horizontal synchronization signal (Hsync).

In addition, during the operation of the polarity signal generator 100 and the first polarity inversion signal generator 102, the second D flip-flop 102*a* receives feedback from it inverted output terminal (BQ2) at an input terminal (D) synchronized with the rising edge of the polarity signal (POLS) from the inverted output terminal (BQ1) of the first D flip-flop 100*a*. In addition, the second D flip-flop 102*a* generates the first polarity inversion signal (POL1), as shown in FIG. 11, wherein the polarity of the first polarity inversion signal (POL1) is inverted every two period of the horizontal synchronization signal (Hsync). Accordingly, the first polarity inversion signal (POL1) generated in the second D flip-flop 100*a* is supplied to the first input terminal of the first polarity inversion signal selector 104 through the non-inverted output terminal (Q2), and is supplied to the second input terminal of the first inversion signal selector 104 through the inverted output terminal (BG2).

The first polarity inversion signal selector 104 selects, in accordance with the selection signal from the first selection signal generator 110, any one of the non-inverted first polarity inversion signal (POL1) and the inverted first polarity signal (POL1) received respectively from the non-inversion output terminal (Q2) and the inversion output terminal (BG2) of the first polarity inversion signal generator 102. Accordingly, the first polarity inversion signal selector 104 may include a multiplexer having two inputs and one output. The multiplexer 104 may be connected to the first selection signal generator 110, i.e., a third D flip-flop 100*a*, that may generate a selection signal (CS) (not shown) inverted for each frame. The third D flip-flop 110*a* may receive the feedback signal from its inverted output terminal (BQ3), synchronize the feedback signal with a rising edge of an inverted vertical synchronization signal (Vsync), and generate the selection signal (CS). Accordingly, the selection signal (CS) generated may be supplied to the input terminal of the first polarity inversion signal selector 104 through non-inverted output terminal (Q3). Since the selection signal (CS) is generated at a reference of the vertical synchronization signal (Vsync), the selection signal (CS) may be inverted on a frame-by-frame basis. Thus, the multiplexer 104 may generate the first polarity inversion signal (POL1) due to the selection signal (CS) received from the third D flip-flop 110*a* inverted on a frame-by-frame basis, and supply the inverted signal to the second polarity inversion signal generator 106, and to the polarity inversion signal output part 108.

A reset circuit 118 may be provided for resetting the first and the second D flip-flops 100*a* and 102*a* every one horizontal synchronization, and may be connected to the polarity signal generator 100 and the first polarity inversion signal generator 102. The reset circuit 118 may include a fourth D flip-flop (DF4) that may delay the vertical synchronization signal (Vsync) received by the clock signal (CLK) by one clock period, a fifth D flip-flop (DF5) that may delay the input signal from the non-inversion output terminal (Q4) of the fourth D flip-flop (DF4) by one clock period by the clock signal (CLK), an XOR gate 134 for performing an Exclusive-Or logic operation of the vertical synchronization and the input signal from non-inverted output terminal (Q5) of the fifth D flip-flop (DF5), and a NAND gate 136 for performing a NAND logic operation of the vertical synchronization signal (Vsync) and the output signal (Q6) from the XOR gate 134. Accordingly, the reset circuit 118 may generate a reset signal (VSRB) for resetting, during each frame unit, a logic state of the first and the second D flip-flops 100*a* and 102*a* on a reference the vertical of synchronization signal (Vsync) for inverting by the vertical synchronization signal (Vsync), i.e. for each frame unit the second polarity inversion signal (POL2) generated by the first and the second D flip-flops 100*a* and 102*a* on a reference of the horizontal synchronization signal (Hsync).

The second polarity inversion signal generator 106 may include an XOR gate for performing an Exclusive-OR logic operation of the first polarity inversion signal (POL1) received from the multiplexer 104 for each frame unit and the polarity signal (POLS) received the polarity signal generator 100. Accordingly, the second polarity inversion signal (POL2) generated by the Exclusive-OR logic operation of the XOR gate 134 may be supplied to the polarity signal output part 108, wherein the polarity signal output part 108 responds to the control signal of the determining part 116 and selects any one of the first polarity inversion signal (POL1) and the second polarity inversion signal (POL2) and supplies the selected one to the data driver 36.

The determining part 116 may include a horizontal synchronization signal counter part 112 for counting a number of the horizontal synchronization signals (Hsync) received during the back porch period of the data enable (DE), and a horizontal synchronization signal number determining part 114 for determining whether the number of the horizontal synchronization signal (Hsync) received during the back porch period of the data enable (DE) in response to whether the number signal received from the horizontal synchronization signal counting part 112 is odd-numbered or even-numbered.

The number determining part 114 may include a sixth D flip-flop (DF6) for providing a delay by one clock period at a rising edge point of the data enable signal (DE) receiving a direct voltage (VCC) supplied to the input terminal applied to its clock terminal, and a seventh D flip-flop (DF7) for providing to the polarity signal output part 108 a delay by one clock period at a rising edge point of the input signal received from non-inverted output terminal (Q6) of the sixth D flip-flop (DF6).

The sixth D flip-flop (DF6) may supply to the clock terminal of the seventh D flip-flop (DF7) through a non-inverted output terminal (Q6) the direct voltage (VCC) that has been delayed by one clock period, and may be reset by the frame unit by a reset signal (VSRB) received from the reset circuit 118. The seventh D flip-flop (DF7) may supply to the polarity inversion signal output part 108 through a non-inverted output terminal (Q7) the input signal from the counter part 112 that has been delayed by one clock period.

The counter part 112 supplying the input signal supplied to the seventh D flip-flop (DF7) may include an eighth D flip-flop (DF8) that delays the direct voltage (VCC) by one clock period. In addition, the direct voltage (VCC) by the one clock period may be supplied to the input terminal at every rising edge of the horizontal synchronization signal (Hsync) as being received the inverted horizontal synchronization signal (Hsync) to clock signal, wherein an XOR gate may perform an Exclusive-OR logic operation on the reset signal (VSRB) received from the reset circuit 118 and the input signal from non-inverted output terminal (Q8) of the eighth D flip-flop (DF8), and first and second counters 140 and 142 may count a number of the input signals received from XOR gate 138.

The eighth D flip-flop (DF8) may be reset for each frame by the reset signal (VSRB) received from the reset circuit 118, and may provide the inverted horizontal synchronization signal (Hsync) to the XOR gate 138 as a one frequency division signal. The XOR gate 138 performs the Exclusive-OR logic function on the input signal received from the reset signal (VSRB) and the sixth D flip-flop (DF6), and supplies the resultant output signal to the first counter 140. The XOR gate 138 supplies a counting start point of time to the first and the second counters 140 and 142 for counting the total number of horizontal synchronization signals (Hsync) supplied during the back porch period of the data enable signal (DE) by the frame unit.

Accordingly, the first counter 140 may be supplied with the inverted horizontal synchronization signal (Hsync) as the clock signal (CLK) by an inverter (IVT), and may count the total number of the horizontal synchronization signals (Hsync). Accordingly, the first counter 140 may be a hexadecimal counter to count the total number of the horizontal synchronization signals (Hsync) loaded by the output signal from the XOR gate 138. The second counter 142 may be synchronized with a carry signal from the first counter 140, may be supplied with the horizontal synchronization signal (Hsync) inverted by the inverter (IVT) as the clock signal (CLK), and may count the horizontal synchronization signals (Hsync). For example, the second counter 142 may count the pulse number of the horizontal synchronization signal (Hsync) up to 16 as being counted by the first counter 140. Likewise, the first and the second counters 140 and 142 may be changed to a variety of integrated counters according to a maximum value of the number of the horizontal synchronization signals (Hsync) supplied during the back porch period of the data enable signal (DE).

The horizontal synchronization signal (Hsync) counted by the second counter 142 during the back porch period of the data enable signal (DE) may be supplied to the seventh D flip-flop (DF7) through the first output terminal (QA) among the output terminals of the second counter 142. Accordingly, the clock signal provided from the first output terminal (QA) among output terminals of the second counter 142 may be provided by a binary type. Accordingly, during a high logic state, the number of the horizontal synchronization signals (Hsync) supplied during the back porch period of the data enable signal (DE) may be an even-number of times. Similarly, during a low logic state, the number of the horizontal synchronization signals (Hsync) supplied during the back porch period of the data enable signal (DE) may be an odd-number of times.

The polarity inversion signal output part 108 may respond to the control signal received from the determining part 116, select among the first and the second polarity inversion signals (POL1) and (POL2), and supply the signal to the data driver 36. More specifically, when the control signal determines that the number of the horizontal synchronization signals (Hsync) supplied during the back porch period of the data enable signal (DE) from the determining part 116 to be an even-number of times, then the polarity inversion signal output part 108, as shown in FIG. 11, may select the first polarity inversion signal (POL1) among the first and the second polarity inversion signals (POL1) and (POL2) and supply the selected one to the data driver 36. When the selection signal determines that the number of the horizontal synchronization signals (Hsync) supplied during the back porch period of the data enable signal (DE) from the determining part 116 to be an odd-number of times, then the polarity inversion signal output part 108, as shown in FIG. 11, may select the second polarity inversion signal (POL2) among the first and the second polarity inversion signals (POL1) and (POL2) and supply the selected one to the data driver 36.

Figure 14:
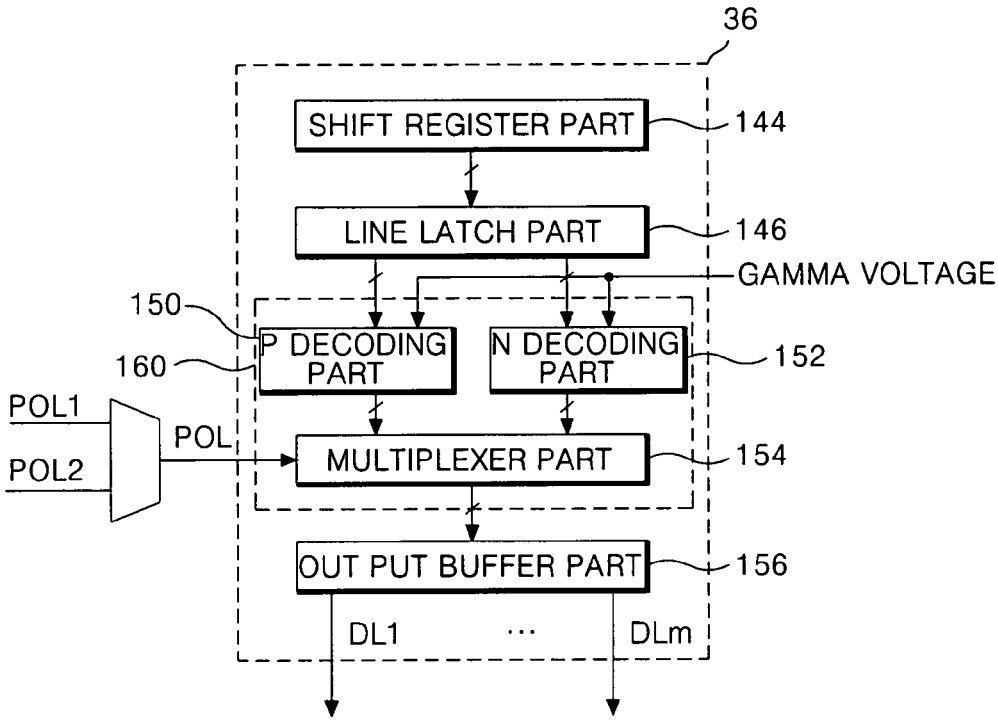
FIG. 14 is a block schematic diagram of an exemplary data driver of the driving apparatus of FIG. 10 according to the present invention.

FIG. 14 is a block schematic diagram of an exemplary data driver of the driving apparatus of FIG. 10 according to the present invention. In FIG. 14, a data driver 36 may change the polarity of the video data according to the first and the second polarity inversion signals (POL1) and (POL2) received from the polarity inversion signal output part 108, and may supply them to the liquid crystal display panel 40. Accordingly, the data driver 36 may include a shift register part 144 for sequentially supplying a sampling signal, a line latch part 146 for simultaneously providing digital video data of red (R), green (G), and blue (B) in response to the sampling signal, a digital-analog converter part (i.e., a DAC part) 160 for converting the R, G, and B digital video data received from the line latch part 146 into a pixel voltage signal, and an output buffer part 156 for buffering the R, G, and B digital video data received from the DAC part 160. A plurality of the data drivers 36 may be provided to drive an N-number of data lines (DL). The N/6 number of shift registers included in the shift register part 144 may cause the source start pulse (SSP) received from the timing controller 34 (in FIG. 10) to be sequentially shifted according to the source sampling clock signal (SSC), and may provide a sampling signal. The line latch part 146 may respond to the sampling signal received from the shift register part 144 and may sequentially latch the R, G, and B digital video data received from the timing controller 34 (in FIG. 10). Accordingly, the latch part may include an N-number of latches in order to latch the N-number of the R, G, and B digital video data, and each of the latches may have a magnitude corresponding to a bit number (i.e, 3-bit or 6-bit) of the R, G, and B digital video data. More specifically, the timing controller 34 may divide the R, G, and B digital video data into even-numbered data and odd-numbered data in order to decrease the transference frequency.

The line latch part 146 may latch the even-numbered data and odd-numbered data supplied through the timing controller 34 during every sampling signal, i.e., 6 numbers of the pixel data. Subsequently, the line latch part 146 may respond to the source output enable signal (SOE) received from the timing controller 34, and may provide the N-numbers of the latched video data. Accordingly, the line latch part 146 may respond to the data inversion selection signal, and may restore the video data that is modulated to reduce a transition bit number. Thus, in order to minimize electromagnetic interference (EMI) during data transmission, the video data where the transited bit number exceeds the reference value may be modulated so that the transition bit number may be reduced.

The DAC part 160 may simultaneously provide the R, G, and B video data recevied from the line latch part 146 into positive and negative pixel voltage signals. Accordingly, the DAC part 160 may include a positive (P) decoding part 150 and a negative (N) decoding part 152 commonly connected to the line latch part 146, and a multiplexer part (MUX part) 154 for selectively outputting signal of the P decoding part 150 and the N decoding part 152.

The N-number of the P decoders included in the P decoding part 150 may convert the N-number of the R, G, and B video data received at the same time from the line latch part 146 into positive pixel voltage signals in use of positive gamma voltage received from the gamma circuit 42. The N-number of the N decoders included in the N decoding part 152 may convert the R, G, and B video data of n-numbers received at the same time from the line latch part 146 into negative pixel voltage signals in use of negative gamma voltage received from the gamma circuit 42.

Figure 15:
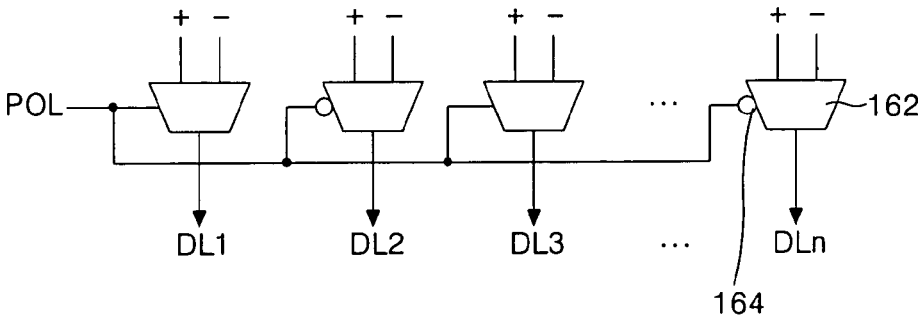
FIG. 15 is a schematic circuit diagram of an exemplary MUX portion of the data driver of FIG. 14 according to the present invention.

FIG. 15 is a schematic circuit diagram of an exemplary MUX portion of the data driver of FIG. 14 according to the present invention. In FIG. 15, the MUX part 154 may respond to the polarity inversion signal (POL) received from the timing controller 34, and may selectively provide the positive pixel voltage signals received from the P decoding part 150 and the negative pixel voltage signals received from the N decoding part 152. More specifically, the MUX part 154 may supply the R, G, and B video data polarity according to the polarity inversion signal (POL) received from the timing controller 34 using the 2-dot inversion method to drive the liquid crystal display panel 40.

For this purpose, each of the multiplexers 162 of the MUX part may include first and second input terminals where the positive (+) data voltage and the negative (−) data voltage from each of the P decoding part 150 and N decoding part 152 are supplied, and a selection signal input terminal where the polarity inversion signal (POL) from the timing controller 34 may be supplied, and an output terminal connected to the output buffer part. Accordingly, the inverter 164 for inverting the polarity inversion signal (POL) from the timing controller 34 may be connected to the selection signal input terminal of the even-numbered multiplexers 162 among the multiplexers 162.

FIGS. 16A and 16B are diagrams showing an exemplary 2-dot inversion signal patterns applied to the liquid crystal display device of FIG. 10 according to the present invention. In FIGS. 16A and 16B, the R, G, and B video data supplied to the liquid crystal display panel 40 received from the data driver 36 may have the polarity of the 2-dot inversion method. Since the polarity of the R, G, and B video data supplied to the liquid crystal display panel 40 from the data driver 36 is supplied to the MUX part 154 that is selected one among the first and the second polarity inversion signals (POL1) and (POL2) by the polarity inversion signal output part 108 of the timing controller 34 according to the number of the horizontal synchronization signals (Hsync) received during the back porch period of the data enable signal (DE).

On the other hand, when the number of the horizontal synchronization signals (Hsync) received during the back porch period of the data enable signal (DE) is an odd number of times, the timing controller 34 may generate the first polarity inversion signal (POL1) and supply it to the MUX part 154. Likewise, when the number of the horizontal synchronization signals (Hsync) received during the back porch period of the data enable signal (DE) is an even number of times, the timing controller 34 may generate the second polarity inversion signal (POL2) and supply it to the MUX part 154.

FIGS. 17A and 17B are diagrams showing additional exemplary 2-dot inversion signal patterns applied to the liquid crystal display device of FIG. 10 according to the present invention. In FIGS. 17A and 17B, the 2-dot inversion driving method changes the polarity of the video data by a 2-dot along a vertical direction except for the first horizontal direction, and is changed by a 1-dot along a horizontal direction.

FIG. 18 is a diagram showing an exemplary flicker inspection pattern according to the present invention. In FIG. 18, a flicker inspection pattern may be used in order to adjust the flicker generated during driving of the liquid crystal display using a 2-dot inversion method. When a liquid crystal display device is driven using a first inversion method, as shown in FIGS. 16A and 16B, the flicker inspection pattern may be represented, as shown in FIG. 18. Accordingly, when the flicker inspection pattern is represented on the liquid crystal display panel 40 of the first inversion method, components are one-half of a frame frequency and appear due to a half-gray pattern of the negative polarity (−), and the flicker may be adjusted. More specifically, as shown in FIGS. 16A and 16B, when driving the liquid crystal display using a 2-dot inversion method, the flicker inspection pattern appears where the number of the horizontal synchronization signals (Hsync) supplied during the back porch period of the data enable signal (DE) is not different at odd- or even-numbered times or even times. Accordingly, the flicker may be adjusted on the liquid crystal display panel 40 due to half-gray pattern of the negative polarity (−).

FIG. 19 is a diagram showing another exemplary flicker inspection pattern according to the present invention. When the liquid crystal display device is driven by the second inversion method, as shown in FIGS. 17A and 17B, the flicker inspection pattern may be represented as shown in FIG. 19. Accordingly, when the flicker inspection pattern is represented on the liquid crystal display panel 40 of the second inversion method, the flicker may be adjusted. More specifically, as shown in FIGS. 17A and 17B, when driving the liquid crystal display device using a 2-dot inversion method, the flicker inspection pattern appears where the number of the horizontal synchronization signals (Hsync) supplied during the back porch period of the data enable signal (DE) is not different at odd- or even-numbered times. Accordingly, the flicker may be adjusted on the liquid crystal display panel 40, due to half-gray pattern of the negative polarity (−).

According to the present invention, the polarity inversion signal identical to the video data polarity of a 2-dot inversion driving method may be provided to a data driver irrespective of the number of horizontal synchronization signals supplied during a back porch period of an data enable signal (DE) during odd- or even-numbers times. Accordingly, by using fixed flicker inspection patterns, the flicker generation on a liquid crystal display panel driven by the 2-dot inversion driving method may be adjusted.

It will be apparent to those skilled in the art that various modifications and variations can be made in the driving method and a liquid crystal display apparatus of the present invention without departing from the spirit or scope of the invention. Thus, it is intended that the present invention cover the modifications and variations of this invention provided they come within the scope of the appended claims and their equivalents.

What is claimed is:

1. A driving apparatus for a liquid crystal display device, comprising:

a liquid crystal display panel having a plurality of data lines and gate lines arranged in a matrix configuration;

a data driver for supplying video data to the data lines;

a gate driver for supplying gate pulses to the gate lines; and a timing controller for controlling polarity of the video data by supplying a selected polarity inversion signal from at least a first and second of polarity inversion signals to the data driver and controlling a timing of the data driver and the gate driver according to number of horizontal synchronization signals supplied during a data banking period, wherein the number of horizontal synchronization signals supplied during the data blanking period is an even-number of times; wherein the at least first and second of the polarity inversion signals are different from each other, and the video data polarity is being controlled by the first polarity inversion signal.

2. The driving apparatus according to claim 1, wherein the polarity of the video data supplied to the liquid crystal display panel is inverted for each of two adjacent pixel cells.

3. The driving apparatus according to claim 1, wherein the data blanking period includes a vertical back porch period spanning from an end of a vertical synchronization signal to a starting point of data enable signals.

4. The driving apparatus according to claim 1, wherein the timing controller comprises:

a polarity inversion signal generator for generating the first polarity inversion signal having a first phase and the second polarity inversion signal having a second phase different from the first phase;

a counting part for counting the number of horizontal synchronization signals supplied during the data blanking period;

a determining part for providing a determining result corresponding to whether the number of the horizontal synchronization signals supplied during the data blanking period is one of an odd-number of times and an even-number of times in accordance with the number counted by the counting part;

a selector for supplying one of the first and second polarity inversion signals from the polarity inversion signal generator according to the determining result of the determining part to the data driver; and a reset driver for generating a reset signal for resetting the polarity inversion signal generator, on a frame-by-frame basis, the detector, the counting part, and the determining part.

5. The driving apparatus according to claim 4, wherein the polarity inversion signal generator comprises:

a polarity signal generator for generating a polarity signal based on the horizontal synchronization signals;

a first polarity inversion signal generator for providing non-inverted and inverted first polarity inversion signals based on the polarity signal;

a polarity inversion selection signal generator for generating a polarity inversion selection signal on a frame-by-frame basis for each frame based on a vertical synchronization signal;

a multiplexer for supplying to the selector by selecting one of the non-inverted and the inverted first polarity inversion signals provided from the first polarity inversion signal generator in response to the polarity inversion selection signal; and a second polarity inversion signal generator for supplying to the selector by generating the first polarity inversion signal supplied from the multiplexer and generating the second polarity inversion signal based on the polarity signal.

6. The driving apparatus according to claim 5, wherein the second polarity inversion signal generator includes an XOR gate for performing an Exclusive-OR logic operation on the first polarity inversion signal and the polarity signal, and for generating the second polarity inversion signal.

7. The driving apparatus according to claim 4, wherein the counting part comprises:

a start signal generator for generating a counting start signal on a frame-by-frame basis; and a plurality of counters for counting the number of the horizontal synchronization signals in response to the start signal.

8. The driving apparatus according to claim 4, wherein the determining part generates a selection signal to select one of the first and second polarity inversion signals in the selector when an input signal received from the counting part is one of a first and second logic values.

9. The driving apparatus according to claim 4, wherein the polarity of the first polarity inversion signal is inverted by two horizontal synchronization signals and the second polarity inversion signal is delayed by one horizontal synchronization signal.

10. A driving method of a liquid crystal display device comprising a liquid crystal display panel having a plurality of data lines and gate lines arranged in a matrix configuration, a data driver for supplying video data to the data lines, and a gate driver for supplying gate pulses to the gate lines, the driving method comprising the steps of:

generating first and second polarity inversion signals different from each other according to a number of horizontal synchronization signals supplied during a data blanking period; wherein the number of horizontal synchronization signal supplied during the data blanking period is an even number of times; and controlling a polarity of the video data by supplying a selected one of the first and the second polarity inversion signals to the data driver, and the video data polarity is controlled by the first polarity inversion signal.

11. The driving method according to claim 10, wherein the polarity of the first polarity inversion signal is inverted by two horizontal synchronization signal units and the second polarity inversion signal is delayed by one horizontal synchronization signal unit.

12. The driving method according to claim 10, wherein the polarity of video data supplied to the liquid crystal display panel is inverted by two adjacent pixel cells.

13. The driving method according to claim 10, wherein the data blanking period includes a vertical back porch period spanning from an end of a vertical synchronization signal to a start point of data enable signals.

14. The driving method according to claim 10, wherein the step of generating the first and the second polarity inversion signals comprises:

generating a polarity signal based on the horizontal synchronization signals;

generating a polarity inversion selection signal based on a frame-by-frame basis based on a vertical synchronization signal;

generating a non-inverted first polarity inversion signal and an inverted first polarity inversion signal based on the polarity signal;

selecting one of the non-inverted and inverted first polarity inversion signals in response to the polarity inversion selection signal; and generating the second polarity inversion signal base on the first polarity inversion signal and the polarity signal.

15. The driving method according to claim 14, wherein the step of generating the second polarity inversion signal includes performing on Exclusive-OR logic operation of the first polarity inversion signal and the polarity signal.

16. The driving method according to claim 10, wherein the step of controlling the video data polarity comprises:

generating a counting start signal for each frame unit;

counting the number of the horizontal synchronization signals in response to the counting start signal;

determining a determining result based on whether the number of horizontal synchronization signals supplied during the data blanking period is one of an odd-number of times or an even-number of times according to the counted number; and supplying one of the first and the second polarity inversion signals according to the determining result to the data driver.

17. The driving method according to claim 10, wherein the number of horizontal synchronization signals supplied during the data blanking period is an even-number of times and the video data polarity is controlled by the first polarity inversion signal.

18. The driving method according to claim 10, wherein the step of generating the first and the second polarity inversion signals and the step of controlling the video data polarity are reset for each frame.

19. A driving apparatus for a liquid crystal display device, comprising:

a liquid crystal display panel having a plurality of data lines and gate lines arranged in a matrix configuration;

a data driver for supplying video data to the data lines;

a gate driver for supplying gate pulses to the gate lines; and a timing controller for controlling polarity of the video data by supplying a polarity inversion signal to the data driver and controlling a timing of the data driver and the gate driver according to a number of horizontal synchronization signals supplied during a data blanking period, wherein a plurality of the polarity inversion signals are different from each other and the timing controller includes:

a polarity inversion signal generator for generating a first polarity inversion signal having a first phase and a second polarity inversion signal having a second phase different from the first phase, a counting part for counting the number of horizontal synchronization signals supplied during the data blanking period, a determining part for providing a determining result corresponding to whether the number of the horizontal synchronization signals supplied during the data blanking period is one of an odd-number of times and an even-number of times in accordance with the number counted by the counting part, a selector for supplying one of the first and second polarity inversion signals from the polarity inversion signal generator according to the determining result of the determining part to the data driver, and a reset driver for generating a reset signal for resetting the polarity inversion signal generator, on a frame-by-frame basis, the detector, the counting part, and the determining part.

20. A driving method of a liquid crystal display device comprising a liquid crystal display panel having a plurality of data lines and gate lines arranged in a matrix configuration, a data driver for supplying video data to the data lines, and a gate driver for supplying gate pulses to the gate lines, the driving method comprising the steps of:

generating first and second polarity inversion signals different from each other according to a number of horizontal synchronization signals supplied during a data blanking period; and controlling a polarity of the video data by supplying the first and the second polarity inversion signals to the data driver, wherein the step of generating the first and the second polarity inversion signals and the step of controlling the video data polarity are reset for each frame.

* * * * *